US007896756B2

(12) United States Patent
Choi

(10) Patent No.: US 7,896,756 B2
(45) Date of Patent: Mar. 1, 2011

(54) APPARATUS FOR TRAINING A GOLF SWING

(76) Inventor: Young Sik Choi, Gwangju (KR)

( * ) Notice: Subject to any disclaimer, the term of this patent is extended or adjusted under 35 U.S.C. 154(b) by 124 days.

(21) Appl. No.: 12/270,667

(22) Filed: Nov. 13, 2008

(65) Prior Publication Data

US 2009/0131188 A1 May 21, 2009

(30) Foreign Application Priority Data

Nov. 15, 2007 (KR) ..... 10-2007-0116835

(51) Int. Cl.
*A63B 69/36* (2006.01)

(52) U.S. Cl. ..... 473/276; 473/207; 473/212; 473/214

(58) Field of Classification Search ..... 473/276, 473/266, 207, 212–214
See application file for complete search history.

(56) References Cited

U.S. PATENT DOCUMENTS

| | | | | |
|---|---|---|---|---|
| 4,229,002 | A | 10/1980 | Masters | |
| 5,096,199 | A * | 3/1992 | Wyatt et al. | 473/212 |
| 5,248,146 | A * | 9/1993 | Viets et al. | 473/206 |
| 5,259,621 | A * | 11/1993 | Keefer | 473/212 |
| 5,447,312 | A * | 9/1995 | Nixon et al. | 473/212 |
| 5,711,716 | A * | 1/1998 | O'Brien et al. | 473/212 |
| 7,033,284 | B2 * | 4/2006 | Yoshimura | 473/276 |
| 7,585,229 | B2 * | 9/2009 | Kelley | 473/276 |
| 2002/0111251 | A1 | 8/2002 | Crump | |
| 2004/0082400 | A1 * | 4/2004 | Yoshimura | 473/276 |
| 2008/0026863 | A1 * | 1/2008 | Eck | 473/212 |
| 2008/0026865 | A1 * | 1/2008 | Kelley | 473/276 |
| 2008/0119299 | A1 * | 5/2008 | Merrill | 473/212 |
| 2009/0131188 | A1 * | 5/2009 | Choi | 473/212 |
| 2009/0197692 | A1 * | 8/2009 | Eck | 473/212 |

FOREIGN PATENT DOCUMENTS

KR 1020030094259 A 12/2003

OTHER PUBLICATIONS

Search Report for co-pending PCT/KR2008/006694 listing relevant art cited by the International Searching Authority.

* cited by examiner

*Primary Examiner*—Raleigh W. Chiu
(74) *Attorney, Agent, or Firm*—McKee, Voorhees & Sease, P.L.C.

(57) ABSTRACT

A golf swing training apparatus allows a user to learn a stable swing motion by acquiring a correct swing posture in performing a swing motion and to train turning motion of the user's shoulder and a rotating motion of the user's waist in a natural manner. The golf swing training apparatus includes: a body, which is arranged between both arms when a user takes an address posture, and has a reverse trapezoid-shape corresponding to a shape formed by the arms. The golf swing training apparatus controls changes in shapes of both arms, such as the interval between the arms becomes widened, bending of elbows, etc. when a golfer performs a swing motion in a swing training so as to guide his/her shoulder and waist to be smoothly turned. As a result, the golfer can learn a stable swing motion.

9 Claims, 8 Drawing Sheets

APPARATUS FOR TRAINING A GOLF SWING

BACKGROUND OF THE INVENTION

1. Field of the Invention

The present invention relates to a golf swing training apparatus, and particularly to a golf swing training apparatus which controls widening of an interval between user's both arms gathered to catch a grip of a club, bending of elbows, etc. when the user performs a swing motion in golf swing training so as to allow the user to acquire proper swing postures so that the user can learn a stable swing motion, thereby training turning of a shoulder and rotating of a waist.

2. Description of the Prior Art

In general, golf is a game in which victory and defeat are decided according to how accurate the impact points of a club and a ball are, or how strong an impact power is. Therefore, in a case of a beginner, correction of an unstable swing posture and an inaccurate impact point is an essential precondition required for a user to be an excellent golfer.

The golf swing motions includes an address posture, a down swing motion, an impact motion, a follow-through motion, and a finish motion. Particularly, due to an unstable swing posture formed in such a manner that an interval between both arms becomes widened or the arms are excessively bent in performing such a swing motion, most beginners can not deliver strong force to a club head hitting a golf ball. Also, due to undesirably changed posture of both arms, a swing motion, in which his/her shoulder and body integrally are turned, can not be smoothly performed.

Therefore, there is a need for the beginner to form a swing trajectory in a state where the interval between both arms is not widened and the arms are unfolded so as to practice taking a correct swing posture requiring a natural shoulder turning and a waist turning motion.

In order to solve the above-mentioned problem, a posture correcting device, which is put on the chest of a user so as to compulsorily control a movement range of both arms, has been recently suggested. However, the device is an assisting device for preventing the interval between both arms from being widened in performing a swing motion. Therefore, the device can not prevent excessive bending of both arms in performing a swing motion so that the device can not make a user recognize a swing point of a swing motion where a body is integrally turned about a shoulder. As a result, there is a problem in that the user can not acquire a correct posture of a basic golf swing.

SUMMARY OF THE INVENTION

Accordingly, the present invention has been made to solve the above-mentioned problems occurring in the prior art, and the present invention provides a golf swing training apparatus which controls widening of an interval between user's both arms gathered to catch a grip of a club, bending of elbows, etc. when the user performs a swing motion in golf swing training so as to allow the user to acquire proper swing postures so that the user can learn a stable swing motion, thereby training turning of a shoulder and rotating of a waist.

Also, the object of the present invention is to provide a golf swing training apparatus which can generate a message signal when performing a correct swing motion.

In accordance with an aspect of the present invention, there is provided a golf swing training apparatus, which including: a body, which is arranged between both arms when a user takes an address posture, and has a reverse trapezoid-shape corresponding to a shape formed by the arms; arm supporting parts, which are arranged at both side surfaces of the body, respectively, the surfaces facing each other, and have an open part, which is opened outward, so as to allow both arms to be seated on and supported by the arm supporting parts in an unfolded state of the arms.

In accordance with another aspect of the present invention, there is provided a golf swing training apparatus including: a body, which is arranged between both arms when a user takes an address posture, and has a reverse trapezoid-shape corresponding to a shape formed by the arms; arm supporting parts, which are arranged at both side surfaces of the body, respectively, the surfaces facing each other, and have an open part, which is opened outward, so as to allow both arms to be seated on and supported by the arm supporting parts in an unfolded state of the arms; and arm holders for covering the open parts of the arm supporting parts, respectively, so as to control change of a shape formed by the arms, such as widening of an interval between the arms, bending of arms respective to each elbow, etc.

Each arm holder is installed in such a manner that it can be retracted and protracted along an inner circumferential surface of the corresponding arm supporting part, guide elongated holes, which have a length in a direction where the arm holder is retraced and protracted, are formed at upper and lower parts of the arm holder, respectively, and the arm supporting part and the arm holder are assembled with each other by a connecting member.

Also, adjusting screws for fixing a position where the arm holder is protracted and retracted are included in the connecting member so as to adjust a range where both arms are surrounded by the arm supporting parts.

The open parts of the arm supporting parts are completely surrounded by the arm holders so as to prevent bending of elbows of the arms seated on the arm supporting parts in an unfolded state, the open parts of the arm supporting parts are partially surrounded by the arm holders so as to allow the elbows to be bent at a certain degree, and the elbows are allowed to be completely bent so that the user can bend his/her arms respective to the elbows in performing a full swing motion.

Also, the arm supporting parts are arranged at different angles.

Also, a posture checking member, which rotates about a hinge part during a part of a swing motion so as to allow the user to acquire a correct swing posture in a swing training, is included at an upper end of a front surface of the body, and a supporting member for supporting the posture checking member is included at the front surface of the body. Herein, the posture checking member and the supporting member make contact with each other in an address motion and an impact motion among swing motions, and are separated from each other in a back swing motion, a down swing motion, a follow-through motion, and a finish motion among the swing motions.

Also, a contact sensor, a signal processing unit, and a controller are included in an interior of the body, the contact sensor measuring a number of contact times when the posture checking member and the supporting member 22 make contact with each other, the signal processing unit converting an analog signal measured by the contact sensor to a digital signal, and the controller calculating the digital signal converted by the signal processing unit 30 into a number of swings according to pre-input information so as to generates a output signal. Then, the output signal generated from the controller is outputted to a display unit included at the front surface of the body.

Also, a vertical sensor for measuring a vertical angle of the body and a horizontal sensor for measuring a horizontal angle of the body are formed at the interior of the body, wherein the vertical angle of the body is measured by the vertical sensor in an address motion and an impact motion, and the horizontal angle of the body is measured by the horizontal sensor in a back swing motion and a follow-through motion, so that an analog signal measured by the vertical sensor and the horizontal sensor is converted to a digital signal by the signal processing unit, and the converted digital signal is calculated into a vertical angle and a horizontal angle by the controller so as to be output through the display unit.

Also, the body includes a message generating unit for generating a message under a control of the controller receiving a sensing signal from the vertical sensor and the horizontal sensor.

Also, the message generating unit generates a message when the body is positioned at a predetermined vertical angle and a predetermined horizontal angle.

Also, the message generating unit includes a lamp for outputting light and a speaker for outputting a melody.

Also, at least arm holding band for controlling change in shapes of both arms is included at each arm supporting part.

Also, the arm holding band 18 has an elastic force.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
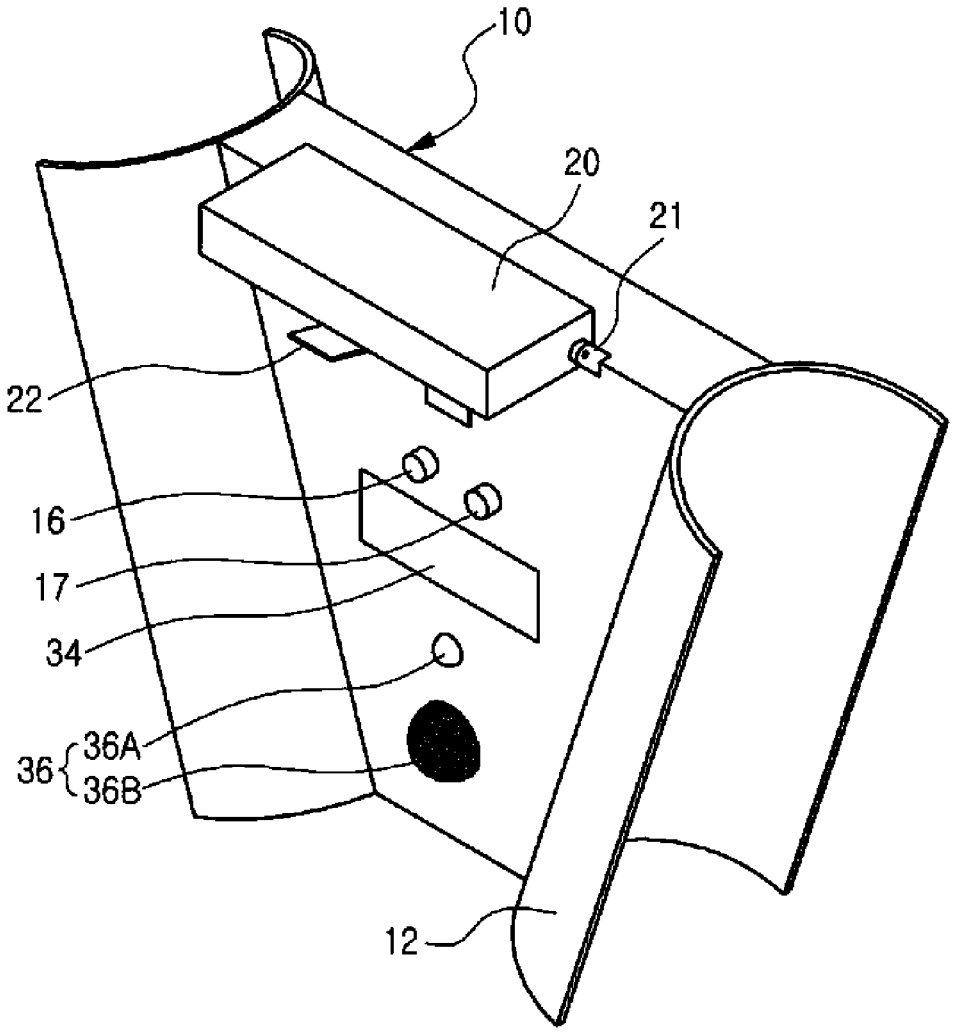
FIG. 1 is a perspective view of a golf swing training apparatus according to a first preferred embodiment of the present invention.
Figure 2:
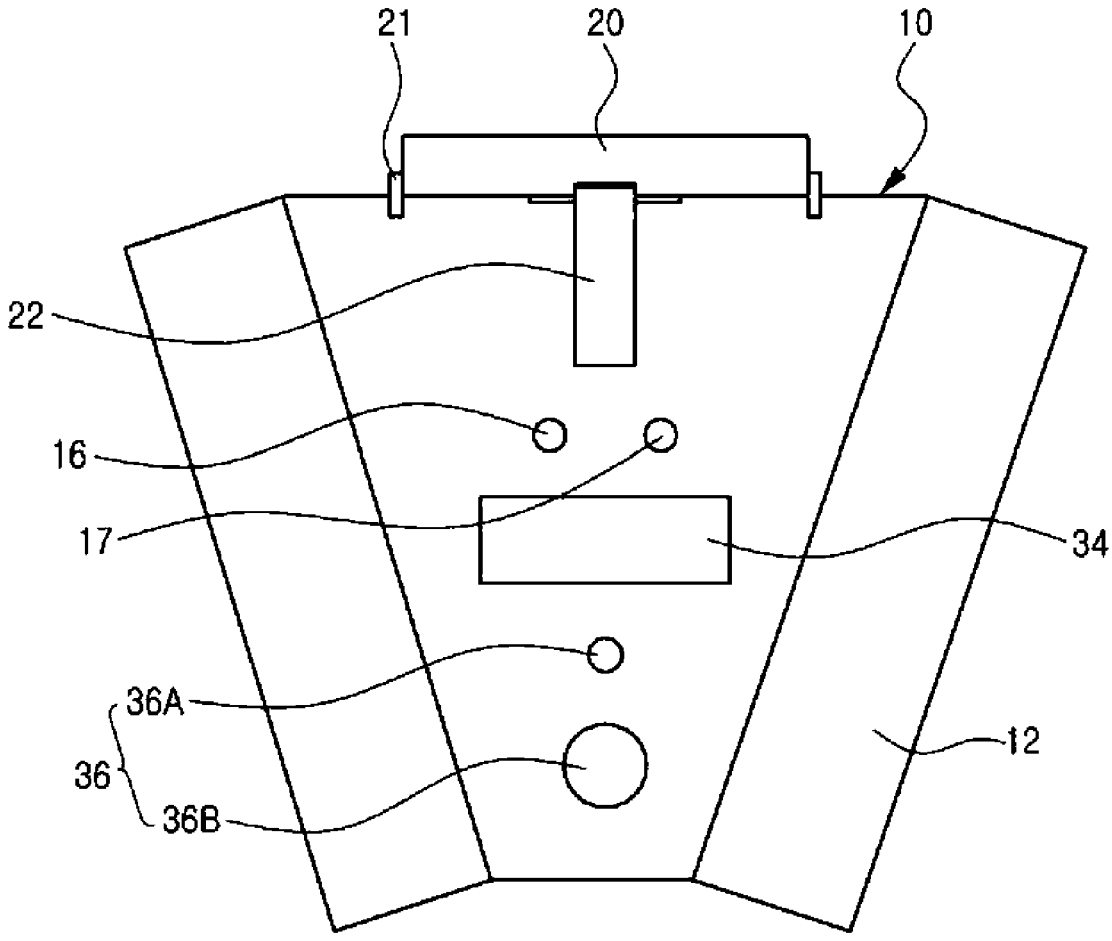
FIG. 2 is a front view of a golf swing training apparatus according to the present invention.
Figure 3:
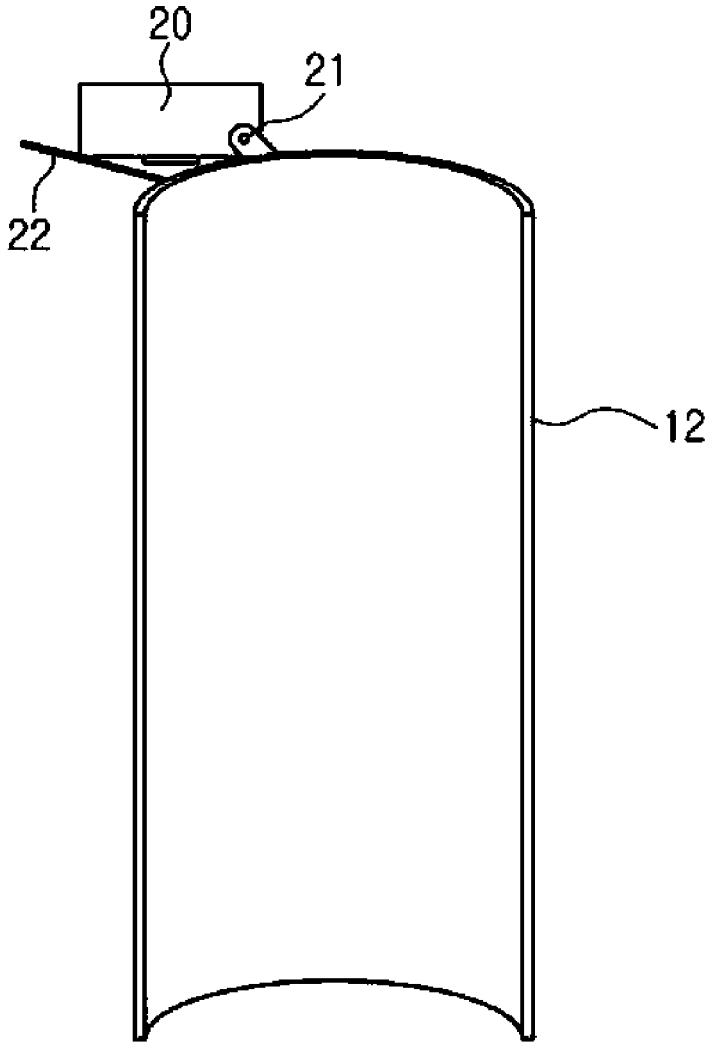
FIG. 3 is a side view of a golf swing training apparatus according to the present invention.
Figure 4:
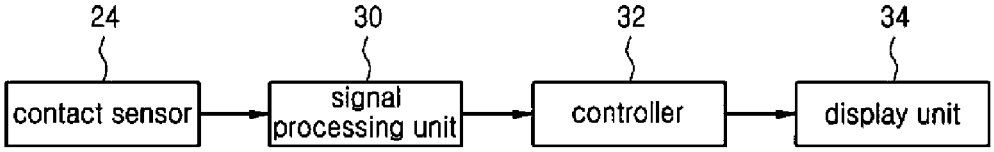
FIG. 4 is a block diagram showing a configuration for measuring the number of swings of a golf swing training apparatus according to the present invention.
Figure 5:
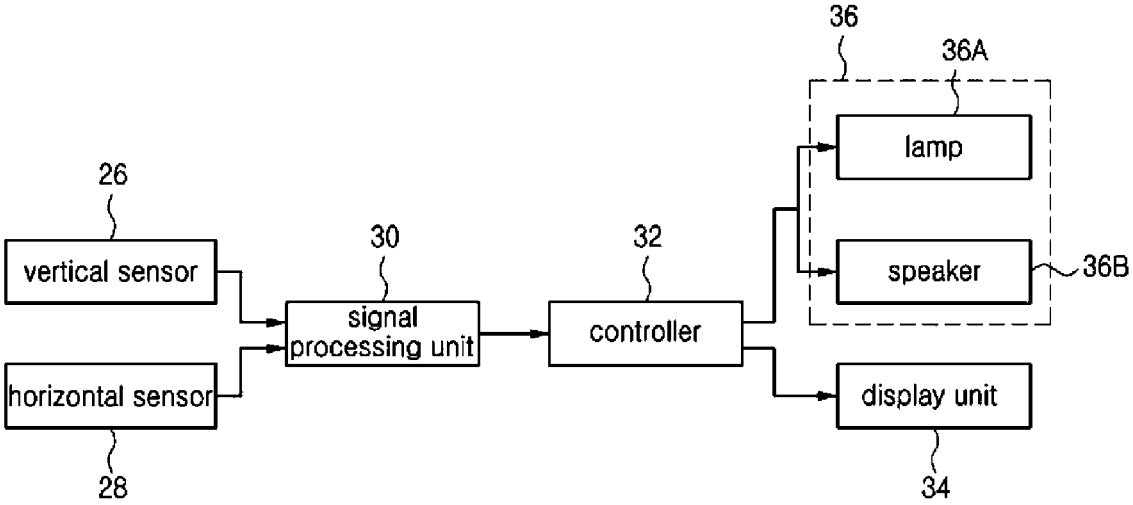
FIG. 5 is a block diagram showing a configuration for generating a message when a body of a golf swing training apparatus according to the present invention is positioned at a predetermined vertical angle and a predetermined horizontal angle in performing a swing motion.

Hereinafter, a golf swing apparatus according to exemplary embodiments of the present invention will be described with reference to the accompanying drawings.

As shown in FIGS. 1 to 5, a golf swing training apparatus according to a first preferred embodiment of the present invention is positioned between a user's arms when he/she takes an address position, and includes a body 10 shaped like a reverse trapezoid so as to correspond to a shape formed by the arms, and arm supporting parts 12, which are arranged at both side surfaces facing each other of the body 10, respectively, and have a side opened outward so as to allow both arms in an unfolded state to be seated thereon and to be supported by the arm supporting parts, respectively.

In more detail, the body 10 is positioned between both arms so as to support the arms gathered in an address posture, which is a basic posture of a swing motion, so as to grip a club properly, and has a shape of a reverse trapezoid so as to correspond to the shape formed by the arms.

Also, the arm supporting parts 12 are formed at both side surfaces facing each other of the body 10 so as to allow both arms in an unfolded state is seated on and supported by the arm supporting parts, respectively. The arm supporting parts 12 have a structure having a section with a semi-circular shape so as to allow one side to be opened outward, thereby stably supporting both arms.

Furthermore, the arm supporting parts 12 are formed at both side surfaces of the body 10, respectively, while each one has a different angle.

That is, the arm supporting parts 12 are formed at both side surfaces of the body 10, respectively, while each one has a different angle so as to correspond each angle of both arms gathered to grip a club in an address position (a left arm is positioned at an angle at a high degree in comparison with the angle of a right arm when the user grips the club to take the address posture). Therefore, the arm supporting parts 12 can allow both arms to be stably seated thereon and support both arms.

Also, although not shown, a rubber pad can be formed at an inner surface of each arm supporting part 12 so as to increase frictional force against both arms seated thereon. The rubber pad increases frictional force between the arm supporting parts 12 and the both arms so that it is possible to prevent the arms from moving on the arm supporting parts 12 when the user performs a swing motion.

Moreover, a posture checking member 20, which has one end connected with a hinge part 21 so as to allow the user to acquire a correct swing posture in training a swing motion, is included at an upper end of a front surface of the body 10. The posture checking member 20 is supported by a supporting member 22 included at a front surface of the body 10. The posture checking member 20 makes contact with the supporting member 22 and rotates about the hinge part 21.

That is, when user performs an accurate swing motion, the posture checking member 20 and the supporting member 22 make contact with each other in an address posture and an impact posture and are separated from each other in a back swing motion, a down swing motion, a follow-through motion, and a finish posture. Therefore, the user can see a state where the posture checking member 20 and the supporting member 22 make contact with each other and a state where they are detached from each other, so that the user can check a swing posture.

Also, a contact sensor 24, which measures the number of contact times where the posture checking member 20 makes contact with the supporting member 22, is included in the interior of the body 10. Also, a vertical sensor 26 for measuring a vertical angle of the body 10 and a horizontal sensor for measuring a horizontal angle thereof are included at the interior of the body 10.

Also, a signal processing unit 30 for converting analog signals measured by each sensor 24, 26, and 28 to digital signals is included at the interior of the body 10. A controller 32, which calculates signals converted by the signal processing unit 30 according to pre-input information and generates an output signal, is included at the interior of the body 10. The output signal generated in the controller 32 is regenerated through a display unit 34 included at a front surface of the body 10. Therefore, an analog signal measured by the contact sensor 24 when the user practices a swing motion is converted to a digital signal in the signal processing unit 30, and the converted digital signal is calculated into the number of swings by the controller 32 according to pre-input information so as to be output through the display unit 34.

That is, when a swing motion is completely performed one time, the posture checking member 20 and the supporting member 22 make contact with each other two times in an address position and an impact position. The controller 32 receives a signal from the contact sensor 24 and the signal processing unit 30, and calculates the signal into the number of swings according to pre-input information so as to output it through the display unit 34. As a result, the user can confirm the number of swings according to swing motions.

Herein, those skilled in the art can easily perform a scheme for measuring the number of contact times according to contact and separation between the posture checking member 20 and the supporting member 22 through the contact sensor 24 by using the phenomenon that current is applied to the posture checking member 20 and the supporting member 22 or not. Therefore, the detailed description of the scheme will be omitted.

Moreover, an analog signal measured by the vertical sensor 26 and the horizontal sensor 28 in performing the swing practice is converted to a digital signal in the signal processing unit 30. The converted digital signal is calculated into a vertical angle and a horizontal angle in the controller 32 according to pre-input information so as to be output through the display unit 34.

That is, the vertical sensor 26 measures a vertical angle of the body 10 in an address posture and an impact posture among the swing motion. The horizontal sensor 28 measures a horizontal angle of the body 10 in a back swing motion and a follow-through position. An analog signal measured by the vertical sensor 26 and the horizontal sensor 28 is converted to a digital signal through the signal processing unit 30, and the converted digital signal is calculated into a vertical angle and a horizontal angle in the controller 32 so as to be output through the display unit 34. As a result, the user can confirm angles regarding the body 10, which is inputted through the display unit 34 in real time, when the user performs a swing motion.

Also, a message generating unit 36 is included in the interior of the body 10. The message generating unit 36 generates a message through a notifying means under the control of the controller 32, which receives sensing signals from the vertical sensor 26 and the horizontal sensor 28 in performing a swing motion, when the body 10 is positioned at a predetermined vertical angle and a predetermined horizontal angle. At this time, the controller 32 compares information inputted through the vertical sensor 26 and the horizontal sensor 28 with pre-input information, and if the body 10 is positioned at the predetermined vertical angle and the predetermined horizontal angle, the controller 32 performs a control operation so that the message generation unit 36 is controlled so that the position of the body is notified to the user.

That is, the predetermined vertical angle of the body 10 is formed in a state where the body 10 is lifted toward a direction of a club at an angle of 15 degrees with respect to a vertical state thereof when the user takes an address posture or performs an impact motion. Also, the predetermined horizontal angle is formed in a state where the body 10 is horizontally positioned when the user performs a back swing motion and a follow-through motion.

Therefore, signals measured from the vertical sensor 26 and the horizontal sensor 28 in real time are inputted into the controller 32 so that when the body 10 is positioned at the predetermined vertical angle and at the predetermined horizontal angle, the controller 32 notifies the position of the body 10 to the user by using a notifying means of the message generating unit 36. As a result, the user recognizes correct swing trajectory through a message of the message generating unit 36, thereby learning an accurate swing posture.

Also, it is desirable to select a lamp 36A for outputting light and a speaker 36B for outputting melodies as the notifying means of the message generation unit 36. However, the notifying means is not limited to these.

At this time, in a case where the body 10 is positioned at the predetermined vertical angle and the predetermined horizontal angle, the lamp 36B lights up with a green color, and the speaker 36B generates a voice signal. Meanwhile, in a case where the body 10 is positioned while escaping the predetermined vertical angle and the predetermined horizontal angle, the lamp 36B lights up with a red color, and the speaker 36B does not generate a voice signal.

Reference numeral "16" not described above indicates a power switch 16, which is included at a front surface of the body 10 and is used for turning the body 10 on/off. The power switch 16 has a configuration which is automatically turned off in a case where the user does not use it for approximately five minutes. Also, reference numeral "17" not described above indicates a reset switch 16, which is disposed adjacent to the power switch 16 and resets the number of swings outputted through the displaying unit 34 to zero.

At this time, the power switch 16, the reset switch 17, etc. are electrically connected with the controller 32, and are executed in such a manner that a signal of each switch is controlled by the controller 32.

The operation of the present invention having such a configuration will be illustrated below.

Figure 6:
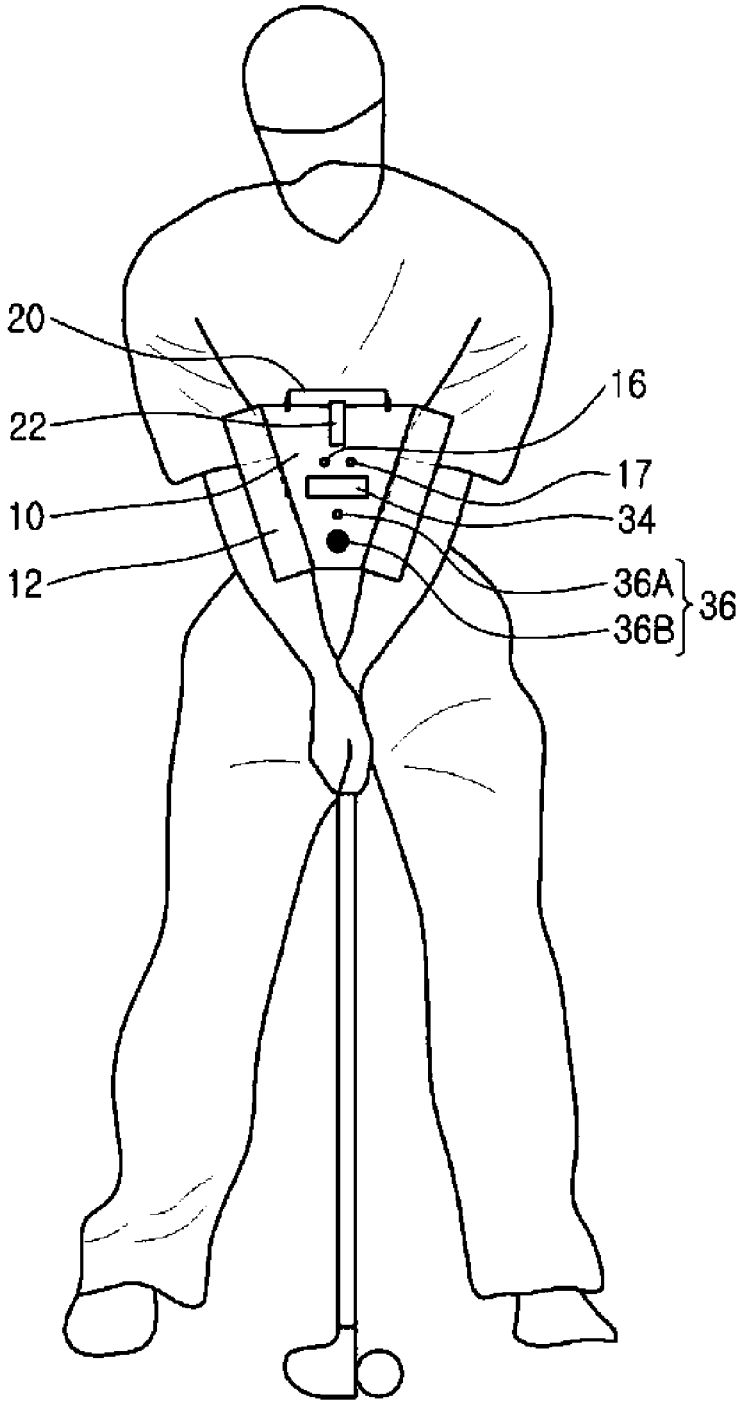
FIG. 6 is a view illustrating a use state of a golf swing training apparatus according to the present invention.

As shown in FIG. 6, the golf swing training apparatus according to the present invention is putted on the user in such a manner that the user's both arms in each unfolded state are seated on the arm supporting parts 12 of the body 10 and are supported by the arm supporting parts 12, respectively, when the user takes an address posture. At this time, the arm supporting parts 12 are arranged at both side surfaces of the body 10 at different angles so as to correspond each angle formed by both arms gathered to grip the club. Therefore, the arms are stably seated on and supported by the supporting parts.

As such, in a state of the user being equipped with the present invention, the user practices a swing motion for swing training, i.e. a series of steps where an address step, a back swing step, a down swing step, an impact step, a follow-through step, and a finish step are sequentially connected.

First, the address step is a step where the user takes an address posture while facing a ball. If a correct address posture is not formed, ball can not fly in a desired direction in spite of any swing. Therefore, the address posture is a basic posture in a swing motion.

That is, in order to take a correct address posture, the user is always conscious of a part of the club, which the user grasps, and the angle of his/her body. It is necessary that a grip isn't positioned in a front side of his/her eyes, and the knee is bent a little. At this time, if the user excessively bends his/her knee or forms his/her back shaped like the back of a cat, the position of his/her hand is moved downward (hand, down). Also, it is preferable that an interval between the end of the grip and the user's body is space having a volume as much as the volume of one and a half of fist and two fists.

Particularly, a state where an angle formed by both arms lifted upward in a vertical direction is 15 degrees after the user grips the club has to be maintained.

In a case where the user takes the address posture as described above, the body 10 notifies the user of the angle formed by both arms through the display unit 34 so that the user (e.g. a beginner) can learn a correct address posture while correcting his/her inaccurate address posture.

At this time, the vertical sensor 26 included in the interior of the body 10 outputs a signal, which is obtained by measuring an angle of the body 10, the angle being equal to an angle formed by both arms lifted upward in the vertical direction so as to grip the club, through the display unit 34 through the signal processing unit 30 and the controller 32. Therefore, the user confirms the angle of the body 10 in real time so that the user can learn an accurate address posture.

Moreover, when the body 10 is positioned at a predetermined vertical angle set by both arms, i.e. is in a state of the body being lifted upward in a vertical direction at 15 degrees. Under the control of the controller, the message generating unit 36 notifies the user of the state of the body 10 by generating light and a voice signals through the lamp 36A and the speaker 36B. The user can recognize the fact that the current posture is a correct address posture through notification of the message generating unit 36.

Then, in the back swing step, the user performs a motion of lifting the club rightward in the address posture. In order to perform a correct back swing motion, it is necessary to form a turning trajectory in such a manner that the user straightens both arms and positions the club in a right side of the user while the user's shoulder and user's body integrally move so as to form a turning trajectory.

Particularly, in a case where the club is positioned at the right side of the user while forming a turning trajectory, the angle formed by both arms, which are positioned in parallel with the ground, is maintained.

As such, when the user takes a back swing posture, the body 10 notifies the user of the horizontal angle of both arms in real time through the display unit 34, similarly to the case of the address posture. Therefore, the user can learn a desirable back swing posture while correcting an inaccurate back swing posture.

At this time, the horizontal sensor 28 included at the interior of the body 10 measures the angle of the body 10, which is equal to the angle formed by both arms positioned in the right side of the user in a state where both arms are positioned in parallel with the ground through the back swing motion, and outputs the measured angle through the display unit 34 through the signal processing unit 30 and the controller 32. As a result, the user can check the angle of the body 10. However, when the user performs the back swing motion, it is difficult for the user to check the angle. Therefore, when the body 10 lifted by both arms is positioned at the predetermined horizontal angle, i.e. is in a state in parallel with the ground, the user can recognize the fact that the current posture is a desirable back swing posture through notification of the message generating unit 36 controlled by the controller 32.

Moreover, in a case when the user straightens both arms and locates the club in the right side of the user while the user's shoulder and body integrally form a turning trajectory so as to perform a back swing, the change of a shape formed by both arms is controlled by the arm supporting parts 12 of the body 10 so that a turning motion of the user's shoulder and a rotating motion of his/her waist are smoothly performed. As a result, the user can train the turning motion of the shoulder and the rotating motion of the waist through acquiring a stable back swing posture.

Then, the down swing motion is a motion performed after the back swing motion before the impact motion, and in this down swing step, the user swings the club to hit the ball. In order to perform a correct down swing motion, it is necessary to from a turning trajectory providing a reverse path equal to the path connecting from the address posture to the back swing posture which has been described above.

When the user takes such a down swing posture, the user can acquire a desirable down swing posture by correcting his/her inaccurate down swing posture through such a stable turning trajectory providing the reverse path having equal to the path connecting from the address posture to the back swing posture which has been described above.

Then, in the impact step, the user hits the ball after the down swing motion. A correct impact posture is formed by combining each rotational force of the club, which is generated along the turning trajectory formed by the address motion, the back swing motion, and the down swing motion, which are sequentially performed.

In a case where the user takes such an impact posture, similarly to the case of the above described address posture, the angle of the body 10 is measured by the vertical sensor 26 so as to be output through the display unit 34 in real time through the signal generating unit 30 and the controller 32. Furthermore, when the body 10 is positioned at a predetermined vertical angle, the position of the body is notified to the user by using light and a voice signal generated through the message generating unit 36. As a result, the user can acquire and recognize a correct impact posture by checking the angle of the body 10 and through notification of the message generating unit 36.

Afterward, in the follow-through step and the finish step, the user performs a motion of lifting up the ball in a left side of the user so as to provide an intended flying distance allowing the ball to accurately fly toward the target after hitting the ball in the impact posture. In order to take a correct follow-through posture, similarly to the back swing posture, it is necessary to form a turning trajectory allowing the club to be located at the left side of the user while his/her shoulder and body integrally form a turning trajectory in a state of the user straightening both arms. At this time, when the club is located in the left side of the user while forming the turning trajectory, it is necessary that the angle formed by both arms positioned in parallel with the ground is maintained so as to be changed into the angle formed by both arms in the finish posture.

In a case where the user takes such a follow-through posture and such a finish posture, similarly to the case of the back swing posture, the body 10 provides a horizontal angle formed by both arms in real time through the display unit 34 when the user performs the follow-through motion. Therefore, the user can acquire a correct follow-through posture and a finish posture by a correcting inaccurate follow-through posture and finish posture.

At this time, similarly to the case of the back swing motion, the body 10 outputs the angle thereof, which is equal to the angle formed by both arms positioned in the left side of the user in a state where both arms are positioned in parallel with the ground by the follow-through motion and the finish motion, so that the user can check the outputted angle of the body. However, it is difficult for the user to check this in performing the follow-through motion. Therefore, the user can recognize the fact that his/her current posture is a correct follow-through posture through a notifying message from the message generating unit 36, which is generated when the body 10 lifted by both arms is positioned at a predetermined horizontal angle, i.e. is positioned in parallel with the ground.

Moreover, in a case when the user straightens both arms and locates the club in the left side of the user while the user's shoulder and body integrally form a turning trajectory so as to perform the follow-through motion and the finish motion, the change of a shape formed by both arms is controlled so that a turning motion of the user's shoulder and a rotating motion of his/her waist are smoothly performed. As a result, the user can acquire the correct follow-through motion, thereby smoothly changing the following through motion into the finish motion. Therefore, the user can train the turning motion of the shoulder and the rotating motion of the waist.

Also, in order to allow the user to acquire a correct swing posture in training a swing motion, the posture checking member 20, which rotates about the hinge part 21 while a part of a swing motion is performed, is included at a front surface of the body 10 in such a manner that it makes contact with and is supported by the supporting member 22. The contact sensor 24, which measures the number of contact times according to contact and separation between the posture checking member 20 and the supporting member 22, is included in the interior of the body 10. Therefore, the user can confirm if he/she takes a correct swing posture by checking the state where the posture checking member 20 and the supporting member 22 make contact with each other or are separated from each other in performing the swing motion. Also, the user can confirm the number of swings according to the swing motions through measurement of the contact sensor 24.

That is, if a swing motion can allow the posture checking member 20 and the supporting member 22 to make contact with each other in an address motion and an impact motion and to be separated from each other in an back swing motion, a down swing motion, a follow-through motion, and a finish motion, the swing motion is an accurate swing motion. Therefore, the user sees a contact state or a separating state between the posture checking member 20 and the supporting member 22 in performing a swing motion, thereby confirming his/her swing posture.

Also, a swing motion is completely performed one time in swing training, the posture checking member 20 and the supporting member 22 make contact with each other two times in an address position and an impact position. Therefore, the controller 32 receives signals from the contact sensor 24 and the signal processing unit 30, and calculates signals into the number of swings according to pre-input information so as to output it through the display unit 34. As a result, the user can confirm the number of swings according to swing motions.

Figure 7:
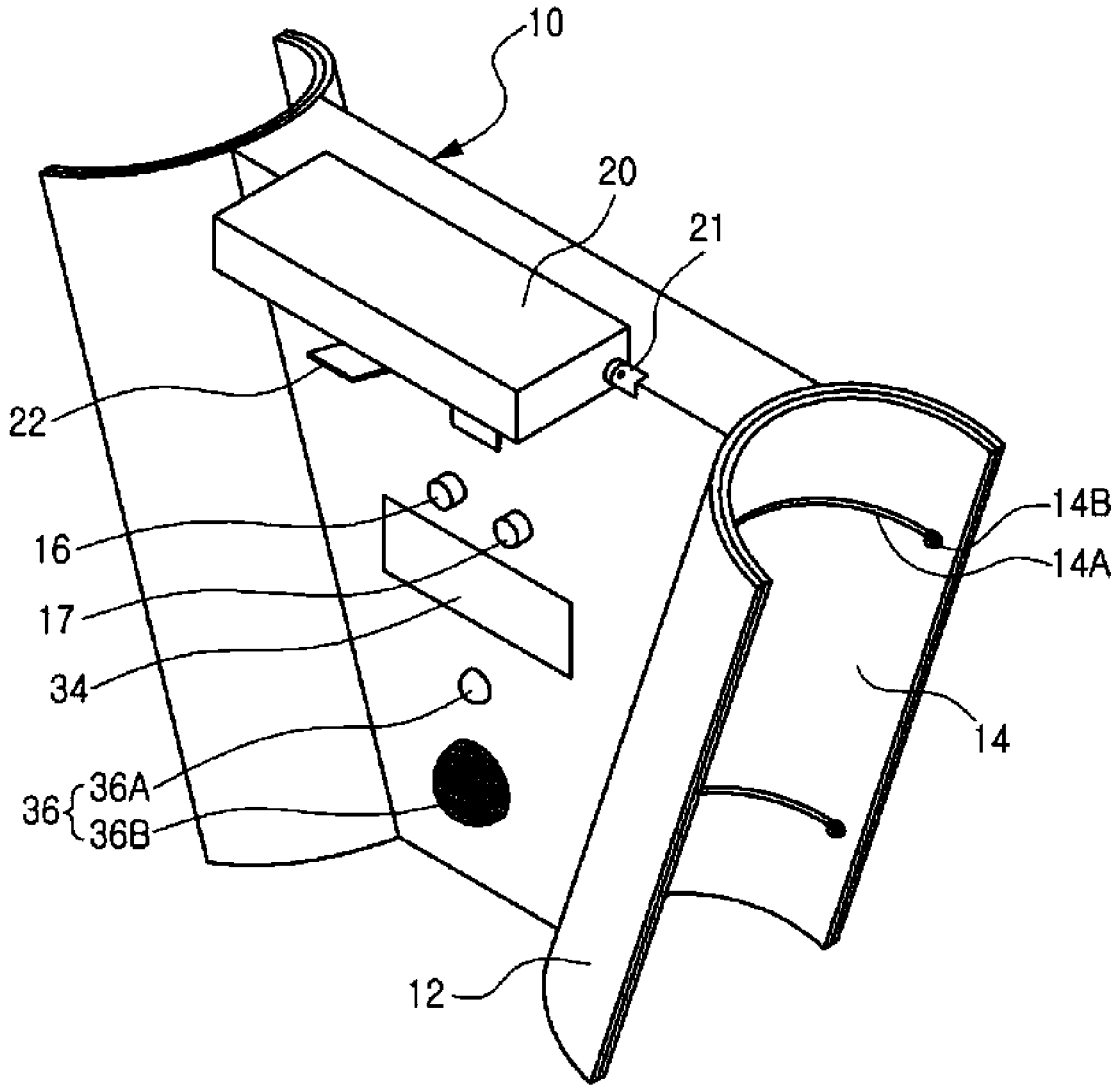
FIG. 7 is a perspective view of a golf swing training apparatus according to a second preferred embodiment of the present invention.
Figure 8:
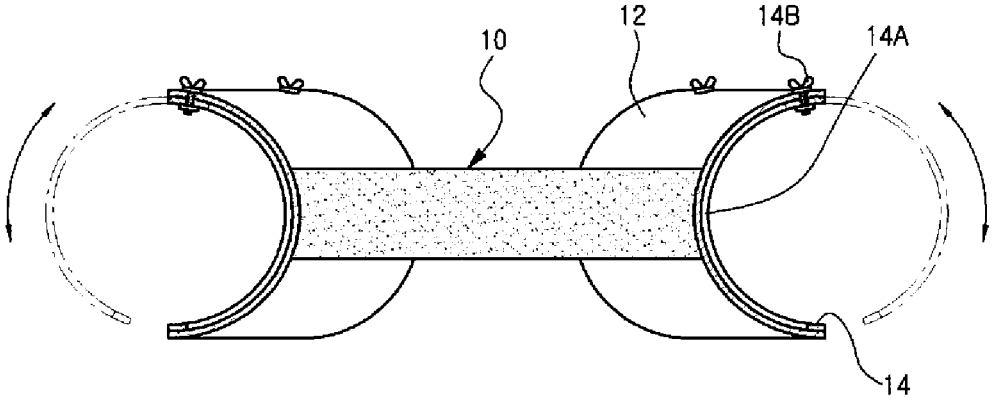
FIG. 8 is a plan view of the golf swing training apparatus shown in FIG. 7.

Meanwhile, as shown in FIGS. 7 and 8, the golf swing training apparatus according to the second embodiment of the present invention further includes arm holders, which have a shape surrounding an opening part of the arm supporting parts 12, respectively, so as to control the change of a shape formed by both arms, such as widening the interval between them, bending of their elbows, etc.

The above-described arm holders 14 play a role for controlling the change in the shapes of the arms seated on the arm supporting parts 12 in an unfolded state by surrounding both arms so as to prevent widening of the interval between both arms and bending of elbows in a swing motion. In order to achieve this, the arm holders have a section with a semicircular shape and are installed along inner circumferential surfaces of the supporting parts 12, respectively, in such a manner that they can be protract toward and retracted from the opening part. Guide elongated holes 14A, which have a length in a protracting/retracting direction so as to appear to and disappear from the opening part of the arm supporting part 12, are formed at upper and lower parts of each arm holder 14, respectively. At this time, each arm supporting part 12 and each arm holder 14 are assembled with each other through connecting members included at one side of the guide elongated holes 14A.

Moreover, adjusting screws 14B for fixing a position where the arm holders 14 are protracted or retracted are included in each connecting member so as to allow the range of a part of each arm surrounded by the arm supporting parts 12 to be adjusted.

That is, in a case of a beginner, both arms in an unfolded state are seated on the arm supporting parts 12, respectively. Then, the opening part of each arm supporting part 12 is completely surrounded by the corresponding arm holder 14 so as to prevent elbows of the supported arms from being bent, and the arm holder is fixed by the adjusting screws 14B. As a result, in performing a swing motion, the elbows of both arms are not bent up to the level of the user's shoulder due to the arm holders 14 so that turning of the shoulder and rotating of waist can be smoothly performed.

Moreover, in a case of an intermediate golfer, a part of the opening part of the arm supporting part 12 is surrounded by the arm holder 14 so as to allow elbows to be bent in a certain degree, and the arm holder is fixed by the adjusting screws 14B. As a result, in performing a swing motion, it is possible to allow the elbows to be bent at a certain degree in a case where both arms are lifted up above the level of his/her shoulder.

Also, in a case of a skilled golfer, the opening part of the arm supporting part 12 is not surrounded by the arm holder 14 so as to allow elbows to be completely bent, and the adjusting screws 14B are fixed by the arm holder. As a result, in performing a swing motion, it is possible to allow the elbows to be bent at a certain degree when the golfer performs a swing motion where both arms are lifted up above the level of his/her shoulder.

In the golf swing training apparatus according to the second embodiment of the present invention, the position where the arm holders are protracted or retracted is fixed by the adjusting screw 14B so as to adjust the range where the arm holders 14 surround both arms in such a manner that the arm holders are protracted along the inner circumferential surfaces of the arm supporting parts 12 respective to the opening part of each arm supporting part 12. As a result, the golf swing training apparatus can control both arms not to be bent. Also, the user performs a smooth swing motion in such a manner that bending of elbows is partially allowed or is completely allowed in a part of the swing motion.

Except for the above described configurations and operations of the golf swing training apparatus according to the second embodiment of the present invention, the remaining configurations and operations thereof are equal to those of the golf swing training apparatus according to the first embodiment of the present invention. Therefore, the description of them will be omitted.

Figure 9:
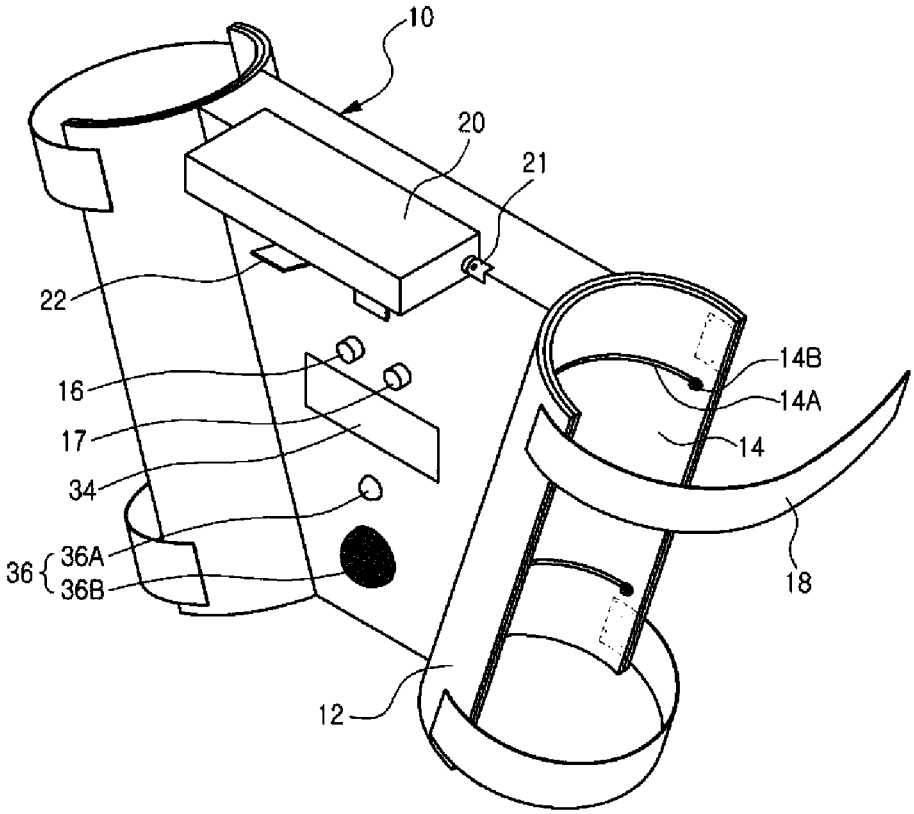
FIG. 9 is a perspective view of a golf swing training apparatus according to a third preferred embodiment of the present invention.

Meanwhile, in the golf swing training apparatus according to the third embodiment of the present invention further, as shown in FIG. 9, at least one arm holding band 18, which adjusts shape of each arm, is included in the arm supporting part 12.

The above-described arm holding band 18 is made of an elastic body.

As a means for connecting the arm holding bands with each other, a velcro tape, snap button, etc. may be selected. However, the means is not limited to these.

According to the golf swing training apparatus according to the third embodiment of the present invention, in a swing training, a proficient user (e.g. an intermediate person), which became skillful in performing a correct swing motion, selectively controls his/her lift or right arm or both arms by simultaneously using the arm holders 14 and the arm holding bands 18 according to each swing motion, thereby controlling the bending of his/her elbows or allowing the bending thereof. Accordingly, the user can perform a basic swing motion or a full swing motion.

Except for the above described configurations and operations of the golf swing training apparatus according to the third embodiment of the present invention, the remaining configurations and operations thereof are equal to those of the golf swing training apparatus according to the first and second embodiments of the present invention. Therefore, the description of them will be omitted.

Figure 10:
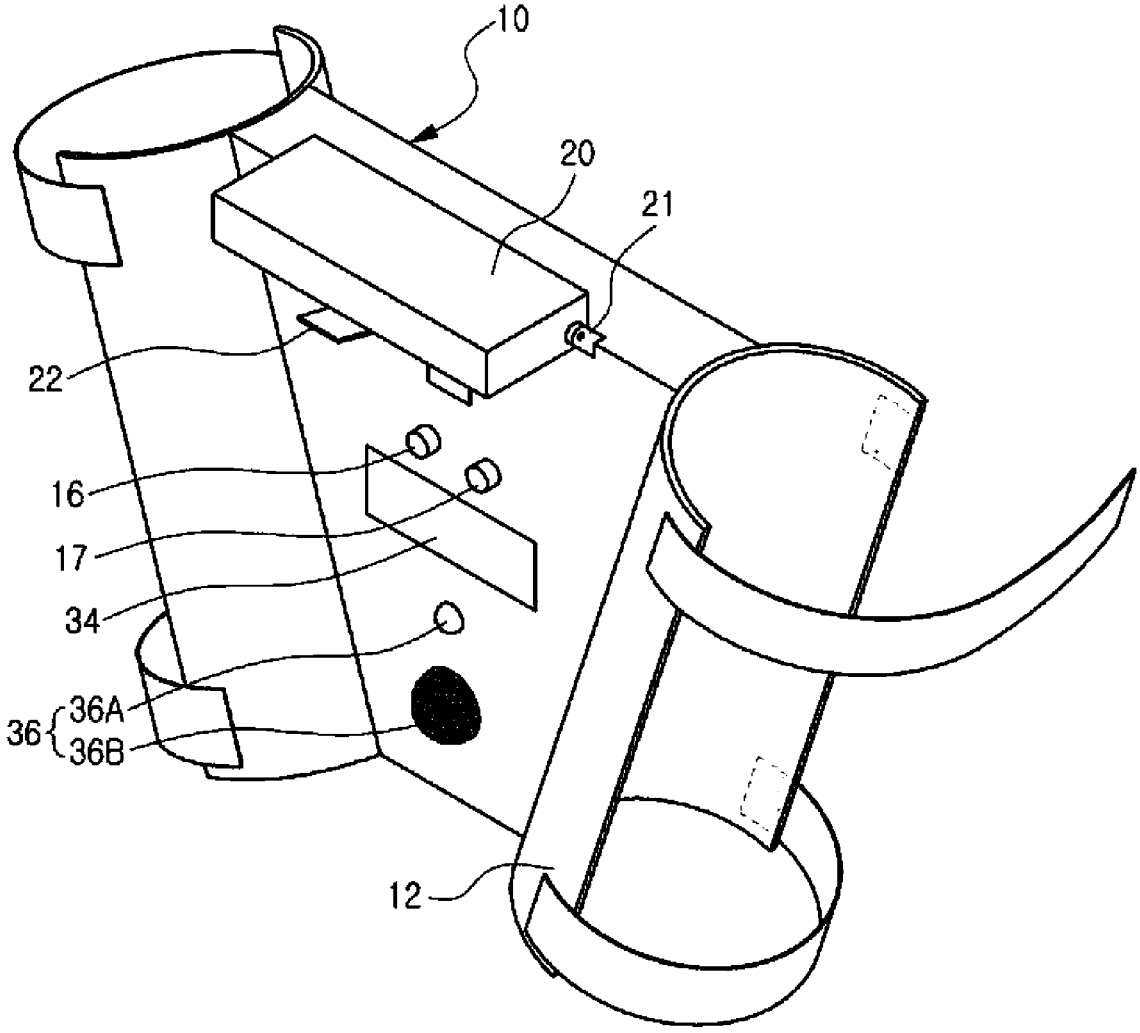
FIG. 10 is a perspective view of a golf swing training apparatus according to a fourth preferred embodiment of the present invention.

Meanwhile, as shown in FIG. 10, according to the golf swing training apparatus according to a fourth preferred embodiment of the present invention, user's both arms, which are seated on and supported by the arm supporting parts 12 in an unfolded state, are held by using only arm holding bands 18 instead of the arm holders 14. Therefore, the apparatus controls elbows not to be bent by using elastic force of the arm holding bands 18 in an address posture, a down swing posture, and an impact posture. Meanwhile, the apparatus allows the elbows to be bent by elbows' force stronger than the elastic force of the arm holding bands 18 in a back swing posture, a follow-through posture, and a finish posture, etc., in which a club is lifted up above the level of the user's shoulder. As a result, the user can smoothly and naturally perform a swing motion.

Except for the above described configurations and operations of the golf swing training apparatus according to the fourth embodiment of the present invention, the remaining configurations and operations thereof are equal to those of the golf swing training apparatus according to the first and second embodiments of the present invention. Therefore, the description of them will be omitted.

The golf swing training apparatus according to the present invention controls changes in shapes of both arms, such as the interval between the arms becomes widened, bending of elbows, etc. when a golfer performs a swing motion in a swing training so as to guide his/her shoulder and waist to be smoothly turned. As a result, the golfer can learn a stable swing motion by acquiring a correct swing posture. As such, there is a useful effect in that the golfer can train the turning motion of his/her shoulder and rotation motion of his/her waist.

Moreover, when the user performs a correct swing motion, a message is generated. Therefore, there is an advantage in that the user can acquire and recognize a correct swing posture through massage notification.

In the above description, although the embodiments of the present invention have been described, the present invention is not limited by those above described embodiments. Those skilled in the art will appreciate that various modifications, additions and substitutions are possible, without departing from the scope and spirit of the invention as disclosed in the accompanying claims.

What is claimed is:

1. A golf swing training apparatus comprising:

a body, which is arranged between both arms when a user takes an address posture, and has a reverse trapezoid-shape corresponding to a shape formed by the arms;

arm supporting parts, which are arranged at both side surfaces of the body, respectively, the surfaces facing each other, and have an open part, which is opened outward, so as to allow both arms to be seated on and supported by the arm supporting parts in an unfolded state of the arms; and arm holders for covering the open parts of the arm supporting parts, respectively, so as to control change of a shape formed by the arms; and wherein each arm holder is installed in such a manner that it can be retracted and protracted along an inner circumferential surface of the corresponding arm supporting part, guide elongated holes, which have a length in a direction where the arm holder is retracted and protracted, are formed at upper and lower parts of the arm holder, respectively, and the arm supporting part and the arm holder are assembled with each other by a connecting member.

2. The golf swing training apparatus as claimed in claim 1, wherein adjusting screws for fixing a position where the arm holder is protracted and retracted are included in the connecting member so as to adjust a range where both arms are surrounded by the arm supporting parts, and wherein the open parts of the arm supporting parts are completely surrounded by the arm holders so as to prevent bending of elbows of the arms seated on the arm supporting parts in an unfolded state, the open parts of the arm supporting parts are partially surrounded by the arm holders so as to allow the elbows to be bent at a certain degree, and the elbows are allowed to be completely bent so that the user can bend his/her arms respective to the elbows in performing a full swing motion.

3. The golf swing training apparatus as claimed in one of claims 1 or 2, wherein the arm supporting parts are arranged at different angles.

4. The golf swing training apparatus as claimed in claim 3, wherein a posture checking member, which rotates about a hinge part during a part of a swing motion so as to allow the user to acquire a correct swing posture in a swing training, is included at an upper end of a front surface of the body, and a supporting member for supporting the posture checking member is included at the front surface of the body, and wherein the posture checking member and the supporting member make contact with each other in an address motion and an impact motion among swing motions, and are separated from each other in a back swing motion, a down swing motion, a follow-through motion, and a finish motion among the swing motions.

5. The golf swing training apparatus as claimed in claim 4, wherein a contact sensor, a signal processing unit, and a controller are included in an interior of the body, the contact sensor measuring a number of contact times when the posture checking member and the supporting member make contact with each other, the signal processing unit converting an analog signal measured by the contact sensor to a digital signal, and the controller calculating the digital signal converted by the signal processing unit into a number of swings according to pre-input information so as to generate a output signal, and wherein the output signal generated from the controller is outputted through a display unit included at the front surface of the body.

6. The golf swing training apparatus as claimed in claim 5, wherein a vertical sensor for measuring a vertical angle of the body and a horizontal sensor for measuring a horizontal angle of the body are formed at the interior of the body, wherein the vertical angle of the body is measured by the vertical sensor in an address motion and an impact motion, and the horizontal angle of the body is measured by the horizontal sensor in a back swing motion and a follow-through motion, so that an analog signal measured by the vertical sensor and the horizontal sensor is converted to a digital signal by the signal processing unit, and the converted digital signal is calculated into a vertical angle and a horizontal angle by the controller so as to be outputted through the display unit.

7. The golf swing training apparatus as claimed in claim 6, wherein the body includes a message generating unit for generating a message under a control of the controller receiving a sensing signal from the vertical sensor and the horizontal sensor.

8. The golf swing training apparatus as claimed in claim 7, wherein the message generating unit generates a message when the body is positioned at a predetermined vertical angle and a predetermined horizontal angle.

9. The golf swing training apparatus as claimed in claim 8, wherein the message generating unit includes a lamp for outputting light and a speaker for outputting a melody.

* * * * *